US005211697A

United States Patent [19]

Kienlein et al.

[11] Patent Number: 5,211,697

[45] Date of Patent: May 18, 1993

[54] UPPER SEAT PART

[76] Inventors: Kurt Kienlein, Ludwigstrasse 10, D-8505 Rothenbach; Peter Forster, Sudetenstrasse 37, D-8501 Cadolzburg, both of Fed. Rep. of Germany

[21] Appl. No.: 691,054

[22] PCT Filed: Sep. 7, 1990

[86] PCT No.: PCT/EP90/01513

§ 371 Date: Jun. 24, 1991

§ 102(e) Date: Jun. 24, 1991

[87] PCT Pub. No.: WO91/03193

PCT Pub. Date: Mar. 21, 1991

[30] Foreign Application Priority Data

Sep. 8, 1989 [DE] Fed. Rep. of Germany ..... 39300218

[51] Int. Cl.[5] ..... A47C 7/02

[52] U.S. Cl. ..... 297/453; 297/458; 297/DIG. 2; 5/901; 5/653

[58] Field of Search ..... 297/453, DIG. 2, 458; 5/468, 481, 653, 900.5, 901

[56] References Cited

U.S. PATENT DOCUMENTS 4,383,342 5/1983 Foster ..... 5/900.5
4,965,898 10/1990 So ..... 5/468

FOREIGN PATENT DOCUMENTS 2625645 12/1977 Fed. Rep. of Germany ..... 5/481
2197785 6/1988 United Kingdom ..... 5/481

*Primary Examiner*—Kenneth J. Dorner
*Assistant Examiner*—Cassandra Hope
*Attorney, Agent, or Firm*—Marmorek, Guttman & Rubenstein

[57] ABSTRACT

The upper seat part according to the instant invention is provided with several ridges 2, 3, 4, 5, 6 extending from its bottom part 1 upward, said ridges being approximately parallel to each other as well as transversal to the seating direction, whereby the forward ridges 2, 3 are inclined toward the front while the other ridges 4, 5, 6 are inclined toward the back. The ridges 2, 3 are equipped laterally, at their upper free ends with projections 7,8 extending approximately at a parallel to the bottom part 1 toward the back side while the ridges 4, 5, 6 inclined toward the back are provided with projections 9, 10, 11 laterally at their upper free ends, said projections extending also approximately at a parallel to the bottom plate 1, however toward the front, so that the projections 7, 8, 9, 10, 11 partly cover the ridge intervals 12 and constitute a seating surface 13 together with the upper free ends of the ridges 1, 3, 4, 5, 6.

5 Claims, 2 Drawing Sheets

UPPER SEAT PART

DESCRIPTION

The instant invention relates to an upper seat part made in one piece of a permanently elastic material, with a bottom part and a front part as well as an opposite rear side.

This upper seat part may be a separate item which is placed on a seat. However this upper seat part may also be or become integrated into a seat and is then the upper layer of this seat and is located directly beneath the seating surface. This upper seat part can of course also be covered with another cover, etc.

Such known upper seat parts are generally used to provide softer seating possibilities. This leads necessarily to a situation where ventilation provoked by loading and unloading processes does not occur or occurs only to an insufficient extent so that perspiring and the usual, highly undesirable phenomena occur. Although this disadvantage could be eliminated by making such upper seat parts thicker, this has again the disadvantage of being cumbersome or of giving the seat an unwanted height resulting in insufficient stability. Furthermore a tendency to slide off, especially in a forward direction, is thereby increased.

It is the object of the instant invention to create an upper seat part of the type mentioned providing sufficient aeration (ventilation) during load fluctuations and thus making it possible to be seated without perspiring while at the same time counteracting any tendency to slide off in a forward direction.

This object is achieved through an upper seat part according to claim 1. Advantageous embodiments are described in the subclaims 2 to 5.

A preferred embodiment of the upper seat part according to the invention is described in greater detail below through the schematic drawings in which.

Figure 1:
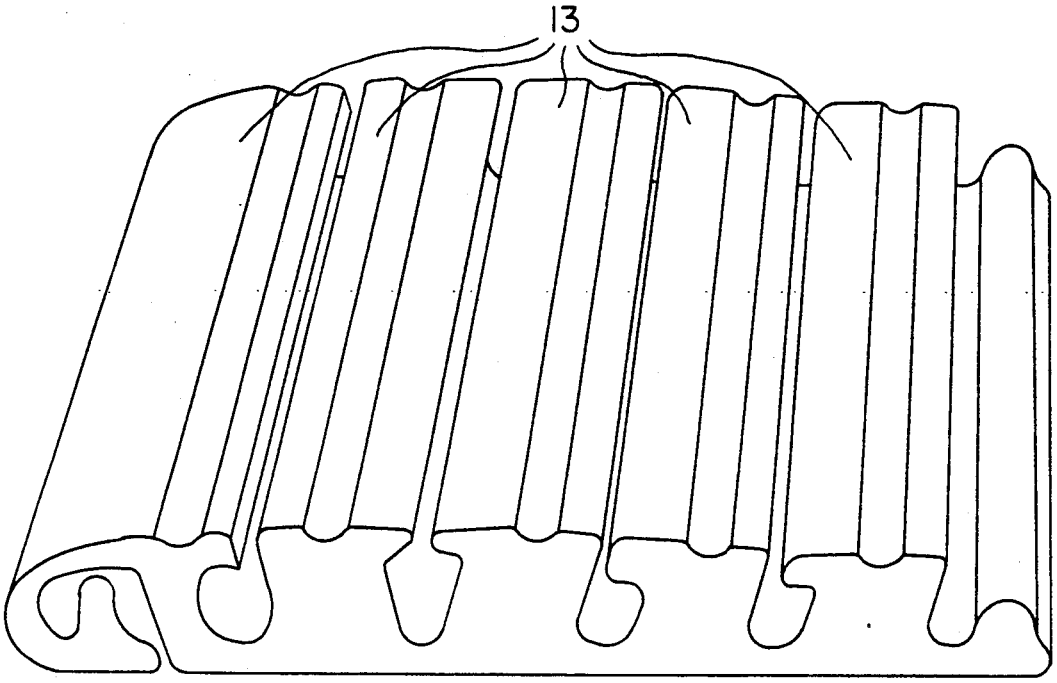
FIG. 1 shows a perspective view of the upper seat part according to the invention and FIG. 2 shows a side-view of same.
Figure 2:
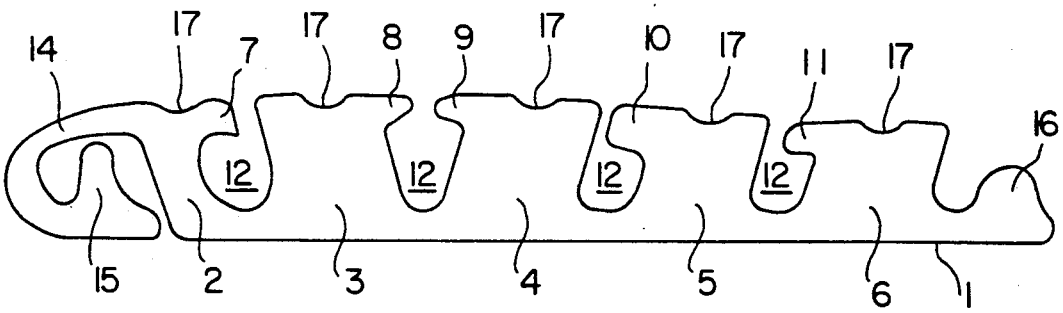
Figure 3:
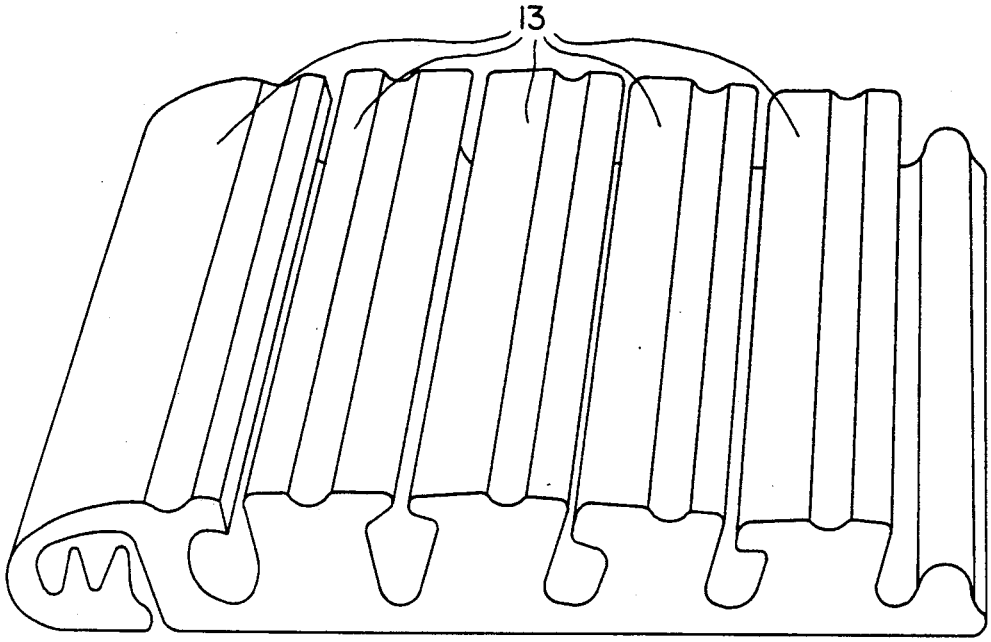
FIG. 3 shows a perspective view of a second embodiment of the upper seat part.
Figure 4:
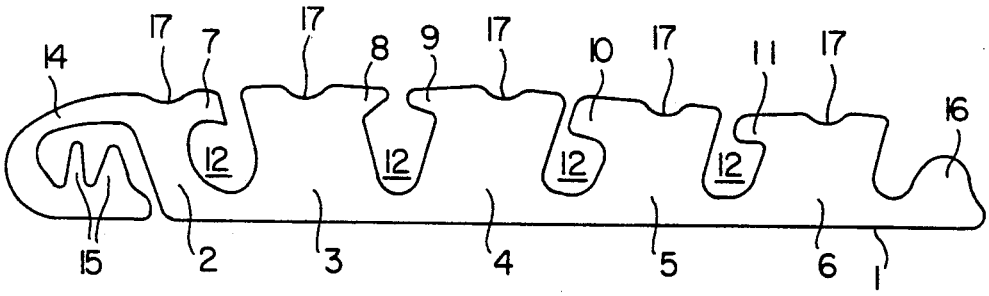
FIG. 4 shows a side-view of the second embodiment.

The upper seat part according to the invention as shown in FIG. 1 is formed in one piece of a permanently elastic material with a volume weight of 40 to 100 kg/m3. The upper seat part is shown in a state without load and has a bottom element 1 with an approximately rectangular base. It can be especially well seen in FIG. 2 that five ridges 2, 3, 4, 5, 6 running transversely to the seating direction extend upward from the bottom element. The ridges 2, 3 are placed here in the forward area, ridge 4 in the central area and the ridges 5, 6 in the rear area. These ridges are approximately parallel to each other and leave ridge intervals 12 free between them. The left side of the upper seat part shown in the figures represents the front, while the right side represents the back. The expression "seating direction" thus designates the direction going from the rear to the front. The ridges 2, 3 are inclined toward the front and are provided laterally projections 7, 8 at their free ends extending approximately horizontally to the front. The ridges 4, 5, 6 are inclined toward the back and are also provided laterally with projections 9, 10, 11 at their free ends extending approximately horizontally but toward the back. These projections partly cover the ridge intervals 12 and together with the upper free ends constitute a seating surface 13, as can be seen in FIG. 1.

Ridge 2 is provided laterally at its upper free end with a flap-like extension 14 which is bent over to the bottom part 1 so that it is flush with the underside of bottom part 1. Several transversely extending supporting ridges 15 are provided on the inside of this flap-like extension 14, extending into the cavity formed through folding.

When the upper seat part is used the ridges 2, 3, 4, 5, 6 are deformed in the direction of inclination, with ridges 2, 3 producing a force acting forward, and ridges 4, 5, 6 a force acting backwards (toward the back-rest). This produces a force resultant directed to the rear and which counteracts any tendency for the user to slide off forward. Furthermore a certain tension of the garment worn by the user and resting upon the seat surface 13 is produced at the same time by the force pair acting in opposite directions, thus preventing wrinkling.

The projections 7, 8, 9, 10, 11 which cover in part the ridge intervals 12 produce a pleasant spring action together with the upper free ends of the ridges and allow for maximum ventilation when loads are shifted, i.e. an aeration of the seating surface 13 produced by application and removal of load so that moistening of the garments in contact with it, caused by the user's perspiring is extensively avoided.

It should furthermore be mentioned that the seating surface 13 slopes down slightly toward the rear. In other words the vertical height of the ridges 3, 4, 5, 6 decreases slightly towards the rear end. This affords a better and more comfortable seating position than that which is achieved by known upper seat parts with a much more pronounced backward slope. By folding over the flap-like extension 14 towards the front on the one hand and the transversely extending supporting ridge 15 on the other hand, ergonomic elements are formed which in turn also contribute to a better and practically non-tiring seating position.

In order to allow ridge 6 to become also fully effective a spacing bead 16 extending parallel to the ridge 6 is provided at the back of the upper seat part to prevent ridge 6 from pushing against a back-rest and thus to lose effectiveness because it is unable to change form to the desired extent in a backward direction. To assist the spring properties and the ventilation the ridges 2, 3, 4, 5, 6 are provided with a groove-type depression 17 on their upper surfaces constituting the seating surface 13, these depressions 17 being parallel to each other.

The forward side with the ridges 2, 3 inclined forward constitutes preferably 1/5 to 2/5 of the overall seating area.

The above described properties according to invention of the upper seat part makes it clear that movements of the seated user (load modification) and/or a somewhat rough ride, when the upper seat part is installed on a vehicle seat, massage of connective tissues and lymph drainage, welcome in general but in particular by wheel-chair users, takes place.

The number of ridges is of course variable and is not limited to the number indicated in the embodiment given as an example.

In practice it is advantageous for the upper seat part to be placed in a casing that may not be too tight so as to allow for the desired deformation.

We claim:

1. An upper seat part made from a permanently elastic material, comprising a bottom part, a forward area, a central area, and a back area opposite to said forward area, said forward area and said back area defining a seating direction, a plurality of ridges extending from said bottom part, said ridges being approximately parallel to each other and running transversely to the seating direction, said ridges including upper free end portions, said ridges in said forward area being inclined forwardly and said ridges in said central and back areas being inclined rearwardly relative to said seating direction, said ridges inclined forwardly including projections extending rearwardly approximately at a parallel to said bottom part, and said ridges inclined rearwardly including projections extending forwardly approximately at a parallel to said bottom part, so that said projections partially enclose ridge intervals, and so that said projections together with said upper free end portions of said ridges constitute a seating surface, said upper seat part further comprising a flap-like prolongation extending from a forward-most ridge, said prolongation being folded down over to said bottom part so that said prolongation encloses a cavity and becomes flush with an underside of said bottom part, and at least one supporting ridge extending from said prolongation into said cavity and running transversely to said seating direction.

2. The upper seat part of claim 1 comprising a plurality of supporting ridges extending from said prolongation into said cavity and running transversely to said seating direction.

3. The upper seat part of claim 1 further comprising a spacing bead behind a rearmost of said ridges, said spacing bead running parallel to said rearmost of said ridges.

4. The upper seat part of claim 1 wherein said plurality of ridges include groove-like depressions on said seating surface, said groove-like depressions running parallel to each other.

5. The upper seat part of claim 1 wherein said permanently elastic material has a volume weight of 40 to 100 $kg/m^3$.

* * * * *